US007717309B1

(12) United States Patent
Lehmberg

(10) Patent No.: US 7,717,309 B1
(45) Date of Patent: May 18, 2010

(54) TENT AND BACKPACK COMBINATION APPARATUS

(76) Inventor: Ned W. Lehmberg, 2790 N. 1050 East, Lehi, UT (US) 84043

( * ) Notice: Subject to any disclaimer, the term of this patent is extended or adjusted under 35 U.S.C. 154(b) by 1135 days.

(21) Appl. No.: 11/350,380

(22) Filed: Feb. 9, 2006

(51) Int. Cl.
*A45F 4/04* (2006.01)

(52) U.S. Cl. ..... 224/154; 224/576; 224/575; 224/628; 280/1.5; 135/96

(58) Field of Classification Search ..... 224/153, 224/154, 156, 158, 575–577, 586, 186–190, 224/257, 259, 261, 628, 633, 634, 160; 5/625, 5/626; 135/95, 96, 87, 117, 904; 280/1.5, 280/30, 32
See application file for complete search history.

(56) References Cited

U.S. PATENT DOCUMENTS

| | | | | | |
|---|---|---|---|---|---|
| 46,195 | A | * | 1/1865 | Weber | 224/154 |
| 3,223,300 | A | * | 12/1965 | Moore et al. | 224/156 |
| 3,464,430 | A | * | 9/1969 | McQuaid | 135/90 |
| 3,550,997 | A | * | 12/1970 | Strand | 280/30 |
| D228,043 | S | | 7/1973 | Sloop | |
| 3,822,813 | A | * | 7/1974 | Carter | 224/154 |
| 3,848,279 | A | * | 11/1974 | Ipsen, Jr. | 5/113 |
| 3,933,164 | A | * | 1/1976 | Ness et al. | 135/95 |
| 3,971,495 | A | * | 7/1976 | Velazquez | 224/154 |
| 4,056,857 | A | * | 11/1977 | Quantz | 5/112 |
| 4,449,481 | A | * | 5/1984 | Dear et al. | 119/771 |
| 4,883,206 | A | | 11/1989 | Miller | |
| 5,240,021 | A | | 8/1993 | Snodgrass | |
| 6,062,446 | A | | 5/2000 | Daneau | |
| 6,085,767 | A | | 7/2000 | Maslow | |
| 6,161,739 | A | * | 12/2000 | Bentzen | 224/153 |
| 6,175,977 | B1 | | 1/2001 | Schumacher et al. | |
| 6,484,912 | B2 | | 11/2002 | Jones | |
| 6,805,269 | B2 | | 10/2004 | Lockard | |
| 6,823,882 | B1 | * | 11/2004 | Innes | 135/125 |

* cited by examiner

*Primary Examiner*—Nathan J Newhouse
*Assistant Examiner*—Peter Helvey

(57) ABSTRACT

A tent and backpack combination apparatus includes a satchel has a front wall, a back wall, a first end wall and a second end wall. A pair of shoulder straps is attached to the back wall. The satchel has an elongated opening therein for accessing an interior thereof. A support is attached to and extends through the satchel. The support includes a lower portion extending away from the first end wall of the satchel that is configured to engage a ground surface. The support includes an upper portion extending away from the second end wall that is configured to support the satchel in a spaced relationship with the ground surface and to angle the satchel upwardly from the first end wall to the second end wall. A sleeve has an open end and the support is positionable in the open end and covered by the sleeve to define a tent.

11 Claims, 4 Drawing Sheets

TENT AND BACKPACK COMBINATION APPARATUS

BACKGROUND OF THE INVENTION

1. Field of the Invention

The present invention relates to tent devices and more particularly pertains to a new tent device for that includes backpack having an integrated tent structure that may be extended outwardly from the backpack, covered and used for a shelter.

2. Description of the Prior Art

The use of tent devices is known in the prior art. While these devices fulfill their respective, particular objectives and requirements, the need remains for a device that allows the convenience of a backpack having an integrated tent for the convenience of a person requiring both a tent and a backpack. Further, the device should be convertible into a wheeled litter device for transporting game or an injured person.

SUMMARY OF THE INVENTION

The present invention meets the needs presented above by generally comprising a satchel has a front wall, a back wall, a first lateral wall, a second lateral wall, a first end wall and a second end wall. A pair of shoulder straps is attached to the back wall. The satchel has an elongated opening therein for accessing an interior of the satchel. A closure is attached to the satchel and is configured to selectively close the elongated opening. A support is attached to and extends through the satchel. The support includes a lower portion extending away from the first end wall of the satchel that is configured to engage a ground surface. The support includes an upper portion extending away from the second end wall that is configured to support the satchel in a spaced relationship with the ground surface and to angle the satchel upwardly from the first end wall to the second end wall. The support is telescopic. A sleeve has an open end and the support is positionable in the open end and covered by the sleeve to define a tent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
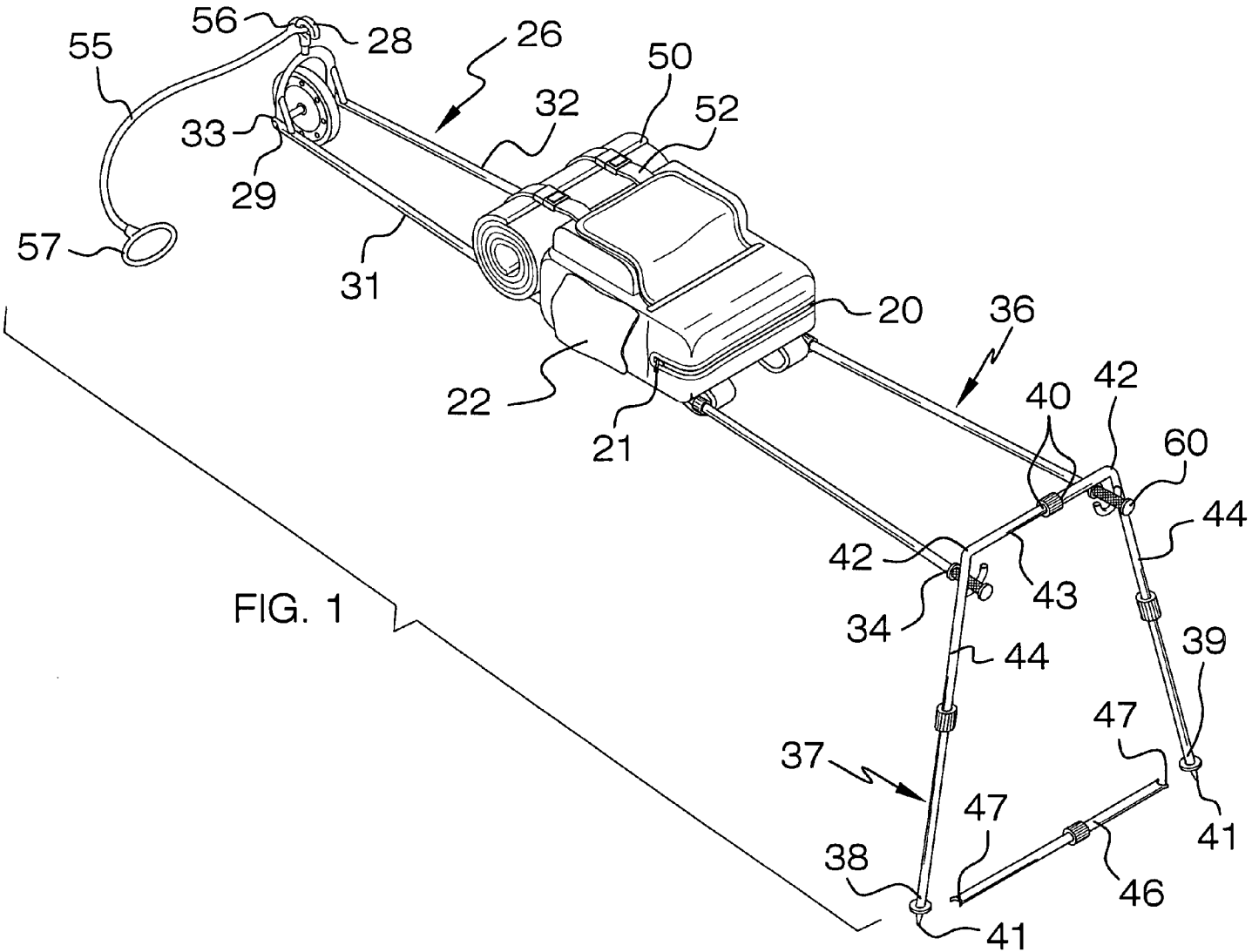
FIG. 1 is a perspective view of a tent and backpack combination apparatus according to the present invention.
Figure 2:
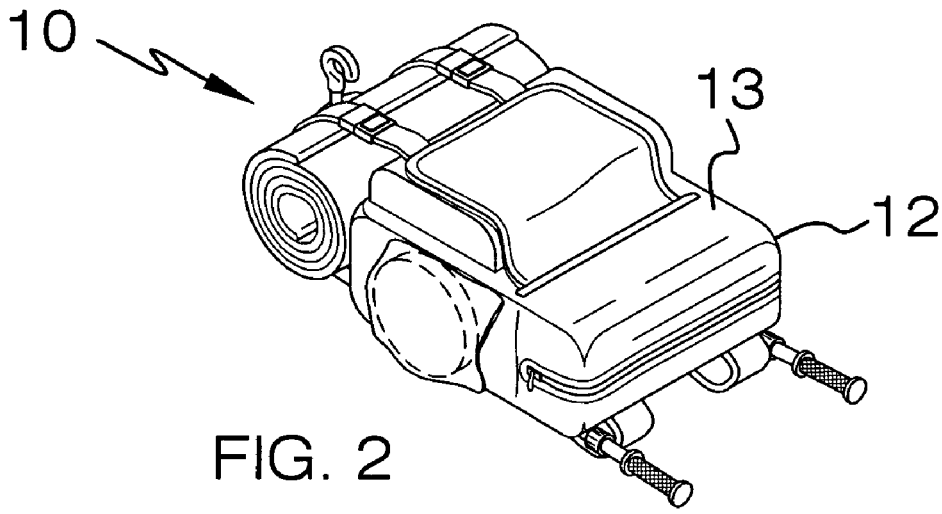
FIG. 2 is a perspective view of the present invention.
Figure 9:
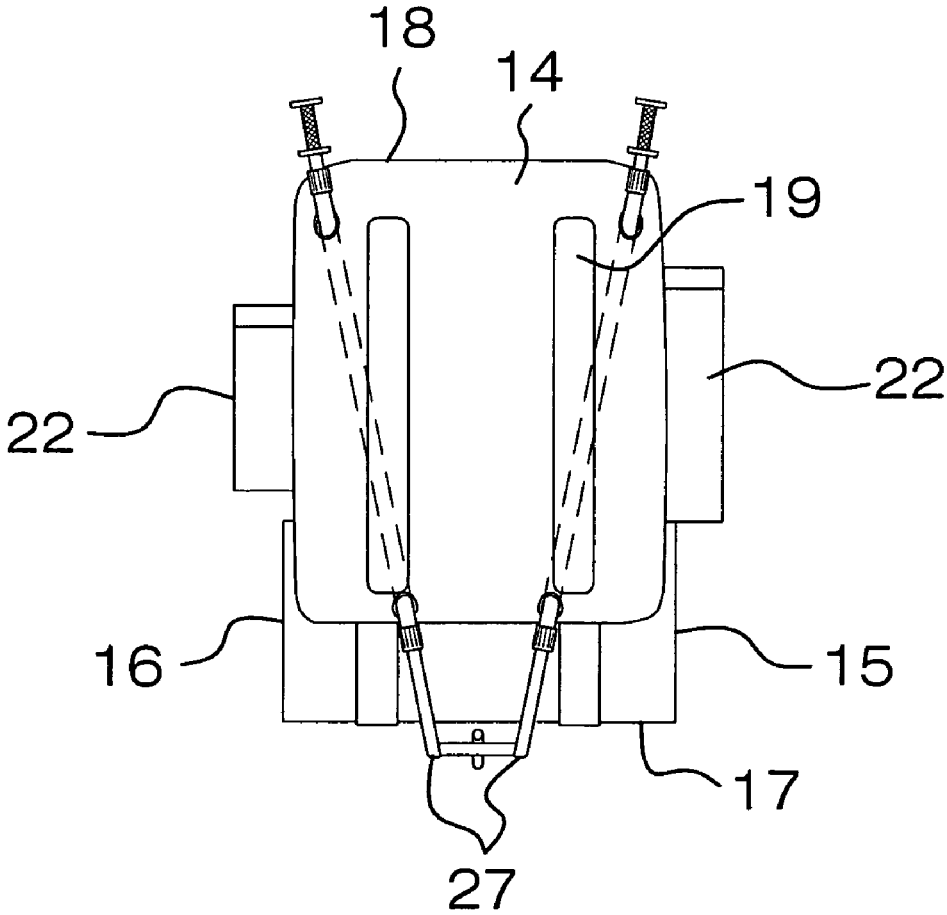
FIG. 9 is a back view of the present invention.
Figure 3:
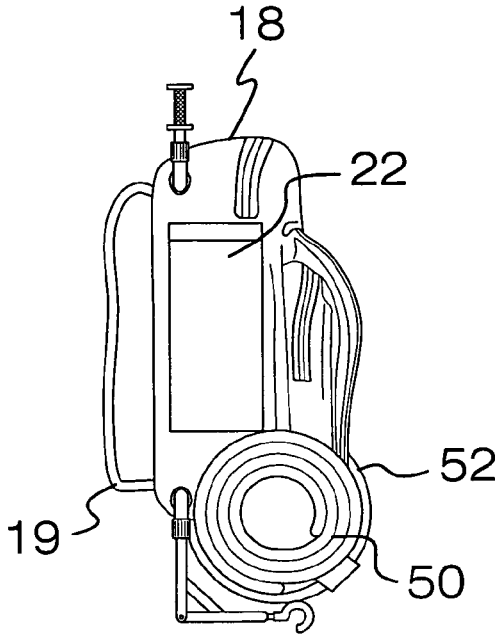
FIG. 3 is a side view of the present invention.
Figure 4:
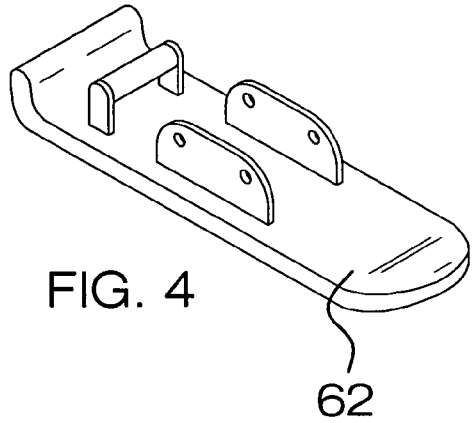
FIG. 4 is a perspective view of a ski of the present invention.
Figure 5:
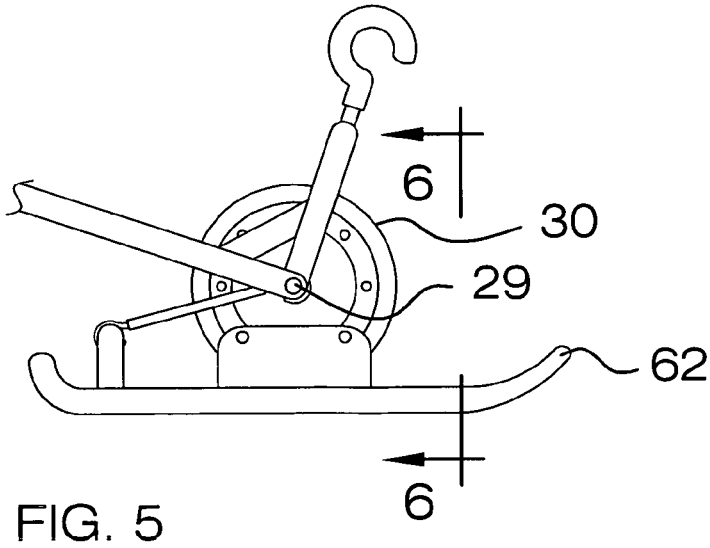
FIG. 5 is a side view of the ski of the present invention.
Figure 6:
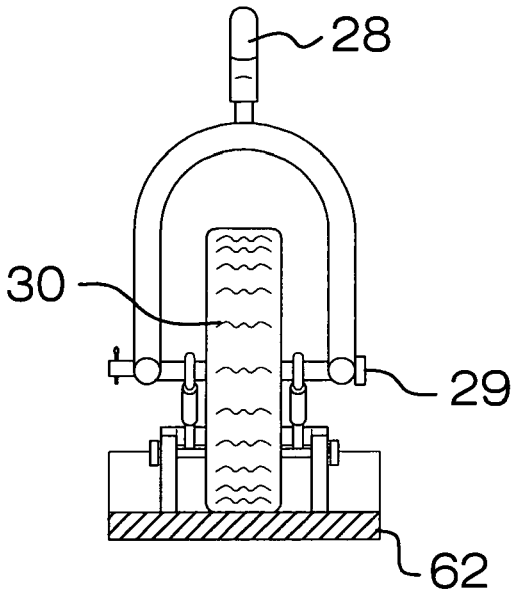
FIG. 6 is a cross-sectional view taken along line 6-6 of FIG. 5 of the present invention.
Figure 7:
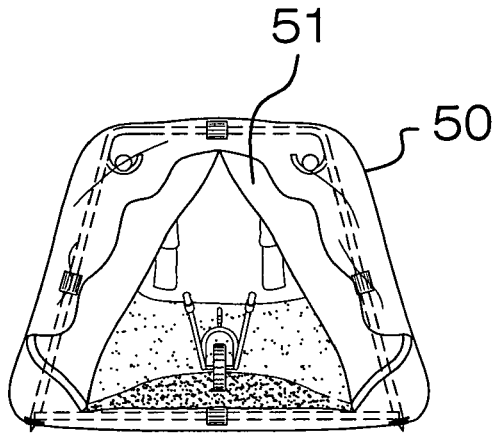
FIG. 7 is an end view of the present invention.
Figure 8:
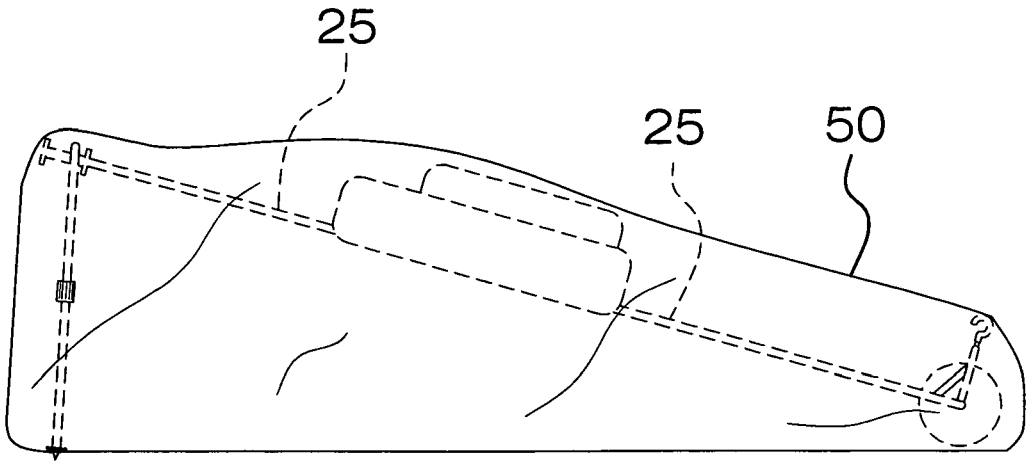
FIG. 8 is a side view of the present invention.

With reference now to the drawings, and in particular to FIGS. 1 through 9 thereof, a new tent device embodying the principles and concepts of the present invention and generally designated by the reference numeral 10 will be described.

As best illustrated in FIGS. 1 through 9, the tent and backpack combination apparatus 10 generally comprises a satchel 12 having a front wall 13, a back wall 14, a first lateral wall 15, a second lateral wall 16, a first end wall 17 and a second end wall 18. A pair of shoulder straps 19 is attached to the back wall 14. The satchel 12 has an elongated opening 20, and preferably a plurality of elongated openings, therein for accessing an interior of the satchel 12. A closure 21 is attached to the satchel 12 and is configured to selectively close the elongated opening 20. The closure 21 is preferably a zipper. A plurality of pockets 22 is attached to an outer surface of the satchel 12.

A support 25 is attached to and extends through the satchel 12. The support 25 includes a lower portion 26 extending away from the first end wall 17 of the satchel 12 and is configured to engage a ground surface. The support 25 includes an upper portion 36 extending away from the second end wall 18 and is configured to support the satchel 12 in a spaced relationship with the ground surface and to angle the satchel 12 upwardly from the first end wall 17 to the second end wall 18. The support 25 is telescopic. The lower portion 26 includes a free end 27 positioned opposite of the satchel 12. A hook 28 is attached to the free end 27 and extends upwardly from a plane of the lower portion 26. A pin 29 is removably extended through the free end 27. A wheel 30 is rotatably mounted on the pin 29. The pin 29 has a longitudinal axis orientated substantially parallel to the first end wall 17. The support 25 includes a first arm 31 and a second arm 32. The first 31 and second 32 arms each extend through the satchel 12. The first 31 and second 32 arms each has a first end 33 and a second end 34. The first ends 33 are aligned with each other and define the free end 27 of the lower portion 26. The second ends 34 extend away from the second end wall 18. The first 31 and second 32 arms taper toward each other with respect to the first ends 33 and taper away from each other with respect to the second ends 34. A vertical portion 37 is configured to engage the second ends 34 and support the second ends 34 above a ground surface.

The vertical portion 37 includes a first elongated member 38 and a second elongated member 39. Each of the first 38 and second 39 elongated members has a top end 40 and a bottom end 41. Each of the first 38 and second 39 elongated members has a bend 42 therein positioned between a respective one of the top 40 and bottom 41 ends. The bends 42 each have an angle between 90 degrees and 145 degrees. The first 38 and second 39 elongated members each include a top section 43 positioned between associated ones of the bends 42 and the top ends 40 and a bottom section 44 positioned between associated ones of the bends 42 and the bottom ends 41. The top ends 40 of the first 38 and second 39 elongated members are removably attached together. Each of the bottom sections 44 is telescopic. Each of the bottom ends 41 is pointed and extendable into the ground surface to horizontally orientate the top sections 43 over the ground surface. A pair of couplers 45 is provided and configured to releasably engage one of the second ends 34 of the first 31 and second arms 32. Each of the coupler 45 is attached to one of the first 38 and second 39 elongated members adjacent to an associated one of the bends 40. A lateral stabilizer 46 is engaged to and extended between bottom sections 44. The lateral stabilizer 46 is telescopic and includes a pair of semi-circular ends 47 that are extended around a portion of each of the bottom sections 44.

A sleeve 50 has an open end 51 and the support 25 is positionable in the open end 51 and covered by the sleeve 50 to define a tent. The sleeve 50 is preferably comprised of a substantially watertight and air impermeable material. A securing member 52 is attached to the satchel 12 and is configured to releasably secure the sleeve 50 to the satchel 12. The securing member 52 preferably includes one or more straps.

A tether 55 is removably attached to the hook 28. The tether 55 includes a loop end 56 and a gripping end 57. The hook 28 may be extended through the loop end 56 to secure the tether 55 to the hook 28 while the gripping end 57 may be used to pull the support 12 and the attached satchel 12.

A pair of handles 60 is provided. Each of the handles 60 is attached to one of the second ends 34 of the first 31 and second 32 arms. The handles 60 allow a person to use the support 12 as a lift with the wheel 30 attached to the free end 29. The support 25 may be used in this fashion for transporting game, an injured person, or other relatively heavy items. A ski 62 is provided that may be removably attached to the wheel 30. This facilitates movement of the support 12 through snow.

In use, the satchel 12 may be used as a conventional backpack. When a person requires a tent, the support 12 may be telescopically extended outwardly from the satchel 12 and the sleeve 50 extended over the support 12 to provide a shelter within. The support 12 may also be used, when needed, for transporting bulky items.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A backpack and shelter combination assembly comprising:

a satchel having a front wall, a back wall, a first lateral wall, a second lateral wall, a first end wall and a second end wall, a pair of shoulder straps being attached to said back wall, said satchel having an elongated opening therein for accessing an interior of said satchel, a closure being attached to said satchel and being configured to selectively close said elongated opening;

a support being attached to and extending through said satchel, said support including a lower portion extending away from said first end wall of said satchel and being configured to engage a ground surface, said support including an upper portion extending away from said second end wall and being configured to support said satchel in a spaced relationship with the ground surface and to angle said satchel upwardly from said first end wall to said second end wall, said support being telescopic;

a sleeve having an open end, said support being positionable in said open end and covered by said sleeve to define a tent;

said lower portion includes a free end positioned opposite of said satchel, a pin being removably extended through said free end, a wheel being rotatably mounted on said pin, said pin having a longitudinal axis orientated substantially parallel to said first end wall;

said support includes a first arm and a second arm, said first and second arms each extending through said satchel, said first and second arms each having a first end and a second end, said first ends being aligned with each other and defining said free end of said lower portion, said second ends extending away from said second end wall, said first and second arms tapering toward each other with respect to said first ends and tapering away from each other with respect to said second ends, a vertical portion being configured to engage said second ends and support said second ends above a ground surface;

a first elongated member and a second elongated member, each of said first and second elongated members having a top end and a bottom end, each of said first and second elongated members having a bend therein positioned between a respective one of said top and bottom ends, each of said bends having an angle between 90 degrees and 145 degrees, each of said first and second elongated members including a top section positioned between associated ones of said bends and said top ends and a bottom section positioned between associated ones of said bends and said bottom ends, said top ends of said first and second elongated members being removably attached together, each of said bottom ends being pointed, each of said bottom ends being extendable into the ground surface to horizontally orientate said top sections over the ground surface; and a pair of couplers configured to releasably engage one of said second ends of said first and second arms, each of said coupler being attached to one of said first and second elongated members adjacent to an associated one of said bends.

2. The combination assembly according to claim 1, further including a plurality of pockets being attached to an outer surface of said satchel.

3. The combination assembly according to claim 1, wherein each of said bottom sections being telescopic.

4. The combination assembly according to claim 1, further including a ski being removably attached to said wheel to facilitate movement of said support through snow.

5. The combination assembly according to claim 1, wherein said vertical portion also includes a lateral stabilizer being engaged to and extended between bottom sections.

6. The combination assembly according to claim 5, wherein said lateral stabilizer is telescopic.

7. The combination assembly according to claim 1, further including a hook being attached to said free end and extending upwardly from a plane of said lower portion.

8. The combination assembly according to claim 7, further including a tether being removably attached to said hook.

9. The combination assembly according to claim 1, further including a pair of handles, each of said handles being attached to one of said second ends of said first and second arms.

10. The combination assembly according to claim 9, further including a ski being removably attached to said wheel to facilitate movement of said support through snow.

11. A backpack and shelter combination assembly comprising:

a satchel having a front wall, a back wall, a first lateral wall, a second lateral wall, a first end wall and a second end wall, a pair of shoulder straps being attached to said back wall, said satchel having an elongated opening therein for accessing an interior of said satchel, a closure being attached to said satchel and being configured to selectively close said elongated opening, a plurality of pockets being attached to an outer surface of said satchel;

a support being attached to and extending through said satchel, said support including a lower portion extending away from said first end wall of said satchel and being configured to engage a ground surface, said support including an upper portion extending away from said second end wall and being configured to support said satchel in a spaced relationship with the ground surface and to angle said satchel upwardly from said first end wall to said second end wall, said support being telescopic, said lower portion including a free end positioned opposite of said satchel, a hook being attached to said free end and extending upwardly from a plane of said lower portion, a pin being removably extended through said free end, a wheel being rotatably mounted on said pin, said pin having a longitudinal axis orientated substantially parallel to said first end wall, said support including a first arm and a second arm, said first and second arms each extending through said satchel, said first and second arms each having a first end and a second end, said first ends being aligned with each other and defining said free end of said lower portion, said second ends extending away from said second end wall, said first and second arms tapering toward each other with respect to said first ends and tapering away from each other with respect to said second ends, a vertical portion being configured to engage said second ends and support said second ends above a ground surface, said vertical portion including;

a first elongated member and a second elongated member, each of said first and second elongated members having a top end and a bottom end, each of said first and second elongated members having a bend therein positioned between a respective one of said top and bottom ends, each of said bends having an angle between 90 degrees and 145 degrees, each of said first and second elongated members including a top section positioned between associated ones of said bends and said top ends and a bottom section positioned between associated ones of said bends and said bottom ends, said top ends of said first and second elongated members being removably attached together, each of said bottom sections being telescopic, each of said bottom ends being pointed, each of said bottom ends being extendable into the ground surface to horizontally orientate said top sections over the ground surface;

a pair of couplers configured to releasably engage one of said second ends of said first and second arms, each of said coupler being attached to one of said first and second elongated members adjacent to an associated one of said bends;

a lateral stabilizer being engaged to and extended between bottom sections, said lateral stabilizer being telescopic;

a sleeve having an open end, said support being positionable in said open end and covered by said sleeve to define a tent, a securing member being attached to said satchel and being configured to releasably secure said sleeve to said satchel;

a tether being removably attached to said hook;

a pair of handles, each of said handles being attached to one of said second ends of said first and second arms; and a ski being removably attached to said wheel to facilitate movement of said support through snow.

* * * * *